US005965068A

United States Patent [19]

Williamson et al.

[11] Patent Number: 5,965,068

[45] Date of Patent: Oct. 12, 1999

[54] REVERSIBLE HUMIDIFIER HOUSING

[76] Inventors: Brian Williamson, 25, Caribou Cr., Kirkland QC, Canada, H9J 2H7; Alain Benoît, 29, Ave du Parc, Châteauguay QC, Canada, J6K 1P7; Cherif Menassa, 39, Shédiac, Kirkland QC, Canada, H9J 2J8

[21] Appl. No.: 09/060,660

[22] Filed: Apr. 15, 1998

[51] Int. Cl.[6] ..... B01F 3/04

[52] U.S. Cl. ..... 261/92; 126/113; 261/DIG. 15

[58] Field of Search ..... 261/80, 83, 92, 261/DIG. 15; 126/113

[56] References Cited

U.S. PATENT DOCUMENTS

| | | | |
|---|---|---|---|
| 3,074,698 | 1/1963 | Sevald | 126/113 |
| 3,431,903 | 3/1969 | Irwin | 126/113 |
| 3,437,318 | 4/1969 | Abbott et al. | 261/24 |
| 3,599,942 | 8/1971 | Herr | 126/113 |
| 3,621,830 | 11/1971 | Geisler et al. | 261/92 |
| 3,659,581 | 5/1972 | Geisler et al. | 261/92 |
| 4,056,582 | 11/1977 | Chow | 261/30 |
| 4,361,523 | 11/1982 | Shepherd | 261/92 |
| 4,490,311 | 12/1984 | Shepherd | 261/92 |
| 5,037,586 | 8/1991 | Mehrholz et al. | 261/142 |

*Primary Examiner*—C. Scott Bushey
*Attorney, Agent, or Firm*—Holland & Knight LLP

[57] ABSTRACT

A reversible housing for a humidifier of the type for attachment to the ducts of a forced air heating system. The housing includes a sheet forming a back wall, a pair of side walls and a top wall integrally hinged to the back wall and pivotable through one-half turn with respect to the latter so as to take two operative positions both protruding forwardly of the back wall depending which one of the back wall faces is disposed flat against the duct. The back wall has a central air passage opening bordered with flanges protruding from each of the back wall faces to connect with a duct opening. One of the side walls has a second air passage with flanges protruding from each of its two faces to selectively connect with a by-pass duct to the left or to the right of the housing. An angular cover and a water tray completes the housing and fit the sheet in either one of its two operative positions. A screwdriver is only required to secure the sheet in either one of its operative positions. A deodorizer body is releasably mounted within the humidifier drum.

21 Claims, 4 Drawing Sheets

76
86
10
24
12
34
6
16
66
84
4
14
8
2
82
75

18
76
24
4
28
34
36
22
68
44
30
36
38
20
56
66
58
32
78
68
38a
26
52
70
50
60
62
26
80
70
82
64
52
38b
38b
48
74
54
72
82
54
72

REVERSIBLE HUMIDIFIER HOUSING

FIELD OF THE INVENTION

The present invention relates to a humidifier to be attached to the ducts of a hot air furnace with the inlet duct positioned either to the left or to the right of the humidifier housing.

BACKGROUND OF THE INVENTION

U.S. Pat. No. 4,361,523 dated Nov. 30, 1982 entitled "Humidifier" and U.S. Pat. No. 4,490,311 dated Dec. 25, 1984, entitled "Drum Humidifier" both to Charles G. Shepherd describe a reversible housing for a humidifier of the type to be attached to the ducts of a forced warm air heating system in such a manner that the humidifier can be assembled with the inlet duct positioned to the left or to the right of the humidifier housing, to conform with the particular requirements of an individual installation. In these patents, the housing forms a rigid box with similar side walls and with a top and bottom wall together with a back wall, the box being closed at the front by a cover. One of the side walls supports a drive unit for the humidifier drum while the other side wall has a flanged air passage across which is mounted a drum shaft support bar. To install the housing with the inlet air either to the left or to the right, the housing must accordingly be rotated half a turn about its horizontal axis. The position of the shaft support bar must be inverted.

The humidifier housing is of rigid and relatively bulky construction so that the housing takes space in the truck of a humidifier installer and the humidifier drum shaft supporting bar is a removable piece which might become loose with use, resulting in cylinder drum rattling.

OBJECTS OF THE PRESENT INVENTION

It is therefore the object of the present invention to provide a humidifier housing which is reversible for installation of the by-pass duct either to the left or to the right of the housing but which obviates the above-noted disadvantages in that it takes a minimum of room prior to installation and in which the drum shaft supporting bar is an integral part of one of the side walls of the housing.

Another object of the present invention is to provide a reversible humidifier housing of the character described which is lightweight in construction, inexpensive to manufacture and very easily and rapidly assembled for right or left use at the installation site while requiring only a screwdriver.

Another object of the present invention is to provide a humidifier of the character described including a deodoriser body within the humidifier drum.

Another object of the present invention resides in the provision of a humidifier housing of the character described in which the water tray in which the humidifier drum dips, forms the bottom wall of the housing.

SUMMARY OF THE INVENTION

The present invention is directed to a reversible housing for a humidifier of the type to be attached to the ducts of a forced air heating system to humidify air circulating in the system, the housing comprising a sheet defining a back wall with a back air passage and adapted to be attached to one of the ducts with either one of its faces flat against the one duct, first and second side walls, first hinge means connecting the side walls to the back wall about spaced hinge axes on either side of the first air passage for pivotal movement to take either one of two operative positions, both protruding forwardly of the back wall depending on which one of the back wall face is to be attached flat against the one duct, drive unit mounting means carried by the first side wall and accessible from both faces of the latter, the second side wall having a side air passage and a humidifier shaft bearing bar secured to the second side wall and extending across the side air passage, the sheet forming a housing component capable of being formed with the side air passage to the left or to the right of the back air passage, depending on the selected operative position of the side walls, to house a cylindrical humidifier drum between the side walls and rotatably supported by the bar at one end and at its other end by a drive unit carried by the mounting means.

Preferably, the sheet is a unitary sheet with fold lines constituting the first hinge means.

Preferably, the sheet further includes duct connector flange means surrounding the side air passage, integral with the second side wall and protruding from both faces of the second side wall for coupling to another one of the ducts in either operative position of the second side wall.

Preferably, the sheet further includes second duct connector flange means surrounding the back air passage, integral with the back wall and protruding from both faces of the back wall for coupling with the one duct with either one of the faces of the back wall flat against the one duct.

Preferably, the sheet further includes hole means in the back wall to enable attachment of the back wall with either one of its faces flat against the one duct.

Preferably, the sheet further includes a top wall, second hinge means connecting the top wall to the back wall about a hinge axis normal to the spaced hinge axes and overlying the back air passage for pivotal movement to take either one of two operative positions protruding forwardly of the back wall respectively, corresponding to the two operative positions of the side walls.

Preferably, the second hinge means is a fold line made in the sheet.

Preferably, each side wall has a top edge and further includes groove means extending along each side edge of the top wall and formed at each of its faces to selectively receive the top edges of the side walls in either one of the two operative positions of the side walls and of the top wall.

Preferably, each side wall has a top edge and a front edge generally normal to and parallel to the back wall respectively, the reversible housing further including a rigid angular cover fitting the top and front edges of each side wall in either one of the two operative positions of the side walls and of the top wall.

Preferably, groove means extend along each side edge of the top wall and formed at each of its faces to selectively receive the top edges of the side walls in either one of the two operative positions of the side walls and top wall.

Preferably, the cover has side flanges releasably overlying the top and front edges of the side walls in either one of the two operative positions of the side walls.

Preferably, the top wall has cover retaining openings to receive tabs of the cover in either one of the two operative positions of the top wall.

Preferably, the reversible housing further includes a rigid water tray forming the bottom wall of the housing, the tray having ears protruding from its periphery to releasably engage tray retaining openings made through the back and side walls along the bottom edges of the latter, the engagement being effected from either face of the back and side walls.

Preferably, the sheet further includes internally threaded nipples formed at the top edge of each side wall and registering with screw receiving holes made through the top wall in either one of the two operative positions of the top and side walls to receive and retain screws for securing the top wall over the side walls in either one of the two operative positions of the top and side walls.

Preferably, the bar forms a transverse nipple with a longitudinally extending slit trough bore for receiving a humidifier drum shaft and releasably retain the shaft with a snap fit.

Preferably, the sheet further includes float valve mounting means formed on each side wall.

Preferably, the drive unit mounting means include internally threaded screw receiving nipples protruding from each face of the first wall and a hole made through the first side wall and located below the nipples protruding from one face of the first wall and above the nipples protruding from the other face of the first wall.

Preferably, a cylindrical deodoriser body is releasably mounted on the drum shaft within the humidifier drum.

The invention is also directed to a humidifier embodying the above noted characteristics.

BRIEF DESCRIPTION OF THE ANNEXED DRAWINGS

In the annexed drawings, like characters indicate like elements throughout.

DETAILED DESCRIPTION OF THE PREFERRED EMBODIMENTS

Figure 1:
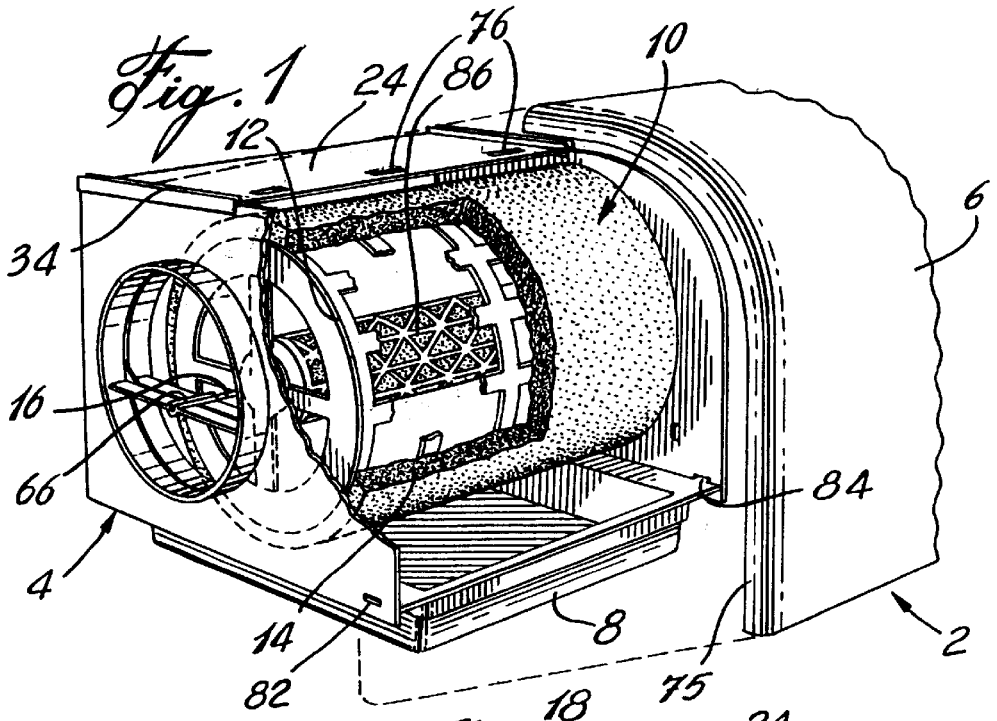
FIG. 1 is a perspective, partially exploded and partially cut-away view of the humidifier with the reversible housing of the invention.

As shown in FIG. 1, the humidifier of the present invention comprises a housing 2 which includes a reversible housing component 4, a cover 6 and a water tray 8. The housing 2 fully encloses a humidifier drum 10 of conventional construction including an opened frame 12 supporting a cylindrical water absorbent open-cell pad 14; drum 10 is supported by a shaft 16 and is rotated by a drive unit (not shown) whereby the drum revolves while partly submerged in the water contained in tray 8. A float valve (not shown) connected to a water supply, automatically maintains the water in tray 8 to a prescribed level. The drive unit is connected to an electric supply source.

This humidifier is for attachment to the ducts of a forced air heating system to humidify air circulating in the system. The housing 2 is connected with the outlet duct of the air furnace so that hot air in this furnace enters the housing around the drum 10, passes through the drum pad 14, is humidified and returns, due to the air pressure differential, to the inlet or return duct of the air furnace by means of a by-pass duct connected to a side air passage of housing 2.

Housing component 4 is reversible so that the side air passage is located at the right or the left depending on the particular arrangement of the outlet and return ducts of the furnace to which the humidifier is to be attached, and also depending on the position of the water supply of the humidifier.

Reversible housing component 4 is made of a one-piece sheet material, for instance of a thermoplastic, which defines a back wall 18, a first side wall 20, a second side wall 22 and a top wall 24. The sheet has fold lines, namely straight lines made of a thinner material which connects the side walls 20, 22 and the top wall 24 to the back wall 18. More particularly, the side walls 20 and 22 are connected to the back wall 18 by means of two spaced parallel fold lines 26 whereas the top wall 24 is connected to the back wall 18 by means of a fold line 28 which is normal to the two fold lines 26. The back wall 18 has a back air passage 30 which is generally rectangular and which is provided at its periphery with a duct coupling flange 32 adapted to enter a similarly shaped opening within the outlet duct of the air furnace with the back wall 18 attached flat against the outlet duct.

It will be noted that flange 32 extends equally from opposite faces of the back wall 18. Flange 32 is integrally moulded with the sheet forming the housing component 4. A rib 34 extends along each side edge of top wall 24 and forms grooves which open at both faces of top wall 24.

An internally screw-threaded nipple 38 is integrally formed with each side wall 20, 22 and registers with a screw receiving hole 42 made in the top wall at the front end of rib 34. Therefore, as clearly shown in FIG. 2, a screw 44 is screwed through hole 42 within nipple 38 to firmly secure each side of top wall 24 to the corresponding side walls 20, 22 while the grooved rib 34 receives the top edge 36 of the side wall to form a sealed joint.

Top edge 36 forms a step 46 (see FIG. 3) adjacent each nipple 38 to be flush with top wall 24 in either operative position of the latter.

First side wall 20 has a through-hole 48, a top pair of screw threaded nipples 38*a* protruding from one face of the side wall above hole 48, and a lower pair of nipples 38*b* protruding from the opposite face of the side wall 20 being disposed below and at an equal distance from hole 48 as top nipples 38*a*. Either pair of nipples 38*a* or 38*b* are used to attach a drive unit of standard construction (not shown) on the outside of side wall 22 using screws which enter the selected nipples and with the drive unit extending through hole 48 to receive the end of the drive shaft 16 of the drum 10. Nipples 38*a* and 38*b* are integrally molded with thin side wall 20 and must therefore protrude from the respective faces of side wall 20.

Figure 2:
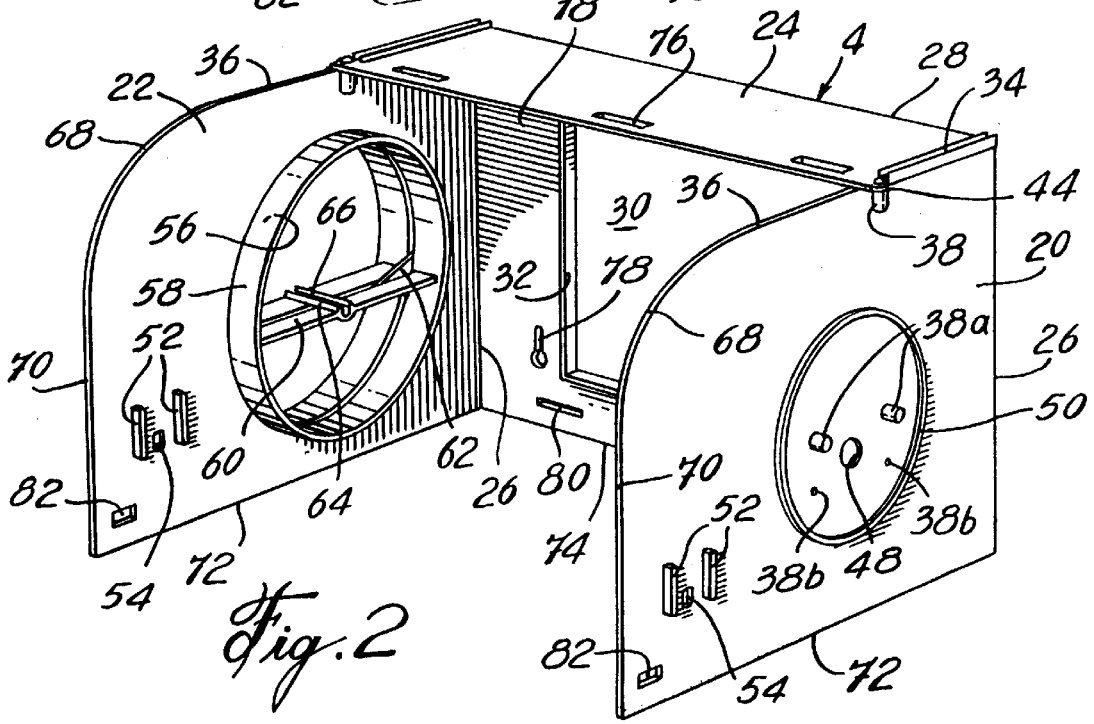
FIG. 2 is a perspective view of the reversible housing, minus the tray and cover.

Therefore, the drive unit is secured by screws always on the outside of wall 20; in the operative position of wall 20 shown in FIG. 2, the casing of the drive unit is screwed within the lower set of nipples 38*b* while in the other position of wall 20, the drive unit would simply be rotated through 180° so that it will be screwed within the upper set of nipples 38*a* and always with the drum shaft engaging part of the drive unit extending through hole 48.

Side wall 20 is further provided with a wall reinforcing collar 50 which surrounds the assembly of nipples 38*a*, 38*b* and hole 48.

Each side wall 20, 22 is integrally formed with a pair of float valve mounting ribs 52 on each side of a through-hole 54 for the passage of the float valve supply pipe normally mounted within the housing just above the tray 8.

Second side wall 22 is formed with a side air passage 56 of circular shape and surrounded by a by-pass duct connecting flange 58 which protrudes equally from both faces of the side wall 22.

A drum shaft support bar 60 extends across side air passage 56; it is reinforced by webs 62 and forms a transverse central nipple 64 with a drum shaft receiving bore opening at both ends of the nipple and which is longitudinally slit as indicated at 66 to receive the drum shaft 16 with a snap fit.

The two side walls 20, 22 are of similar shape, each with a straight top edge 36 extended by a curved edge 68 and a straight vertical front edge 70 extended by a straight bottom edge 72 which coincides with the bottom edge 74 of the back wall 18.

Cover 6 is made of rigid material and has an angular shape to conform with the edges of the side walls 20, 22 and has side flanges 76 which overlie the top edges 36, curved edges 68 and front edges 70 of the two side walls. At the top of the cover there is provided L-shaped retaining tabs (not shown) which are adapted to enter and fit into cover retaining slots 76 made along the front edge of top wall 24. The slots 76 can receive the tabs of the cover from either face of top wall 24.

Back wall 18 has key holes 78 at the four corners of back air passage 30 for attaching one or the other face of the back wall flat against the outlet duct of the furnace with the outward part of flange 32 entering the furnace duct opening.

Back wall 18 has tray retaining openings 80 formed along the bottom edge 74 thereof at the same level as tray retaining openings 82 formed in the side walls 20 and 22. Openings 80, 82 are adapted to receive, from either face of the side walls and back wall, ears 84 laterally protruding at the periphery of the water reservoir tray 8 so as to retain the tray in proper position.

It will be noted that, if necessary, the tray can be removed by simply removing cover 6 and spreading apart the bottom portions of the two side walls 20 and 22 to release the ears 84 from the openings 80, 82. Tray 8 closes the bottom of housing 2 apart from acting as a water reservoir.

In accordance with another feature of the present invention, a cylindrical deodorant body 86 may be removably inserted on the drum shaft 16 inside the drum chassis 12 so as to deodorise the humidified air discharged within the drum before it issues through the side air passage 56.

Figure 3:
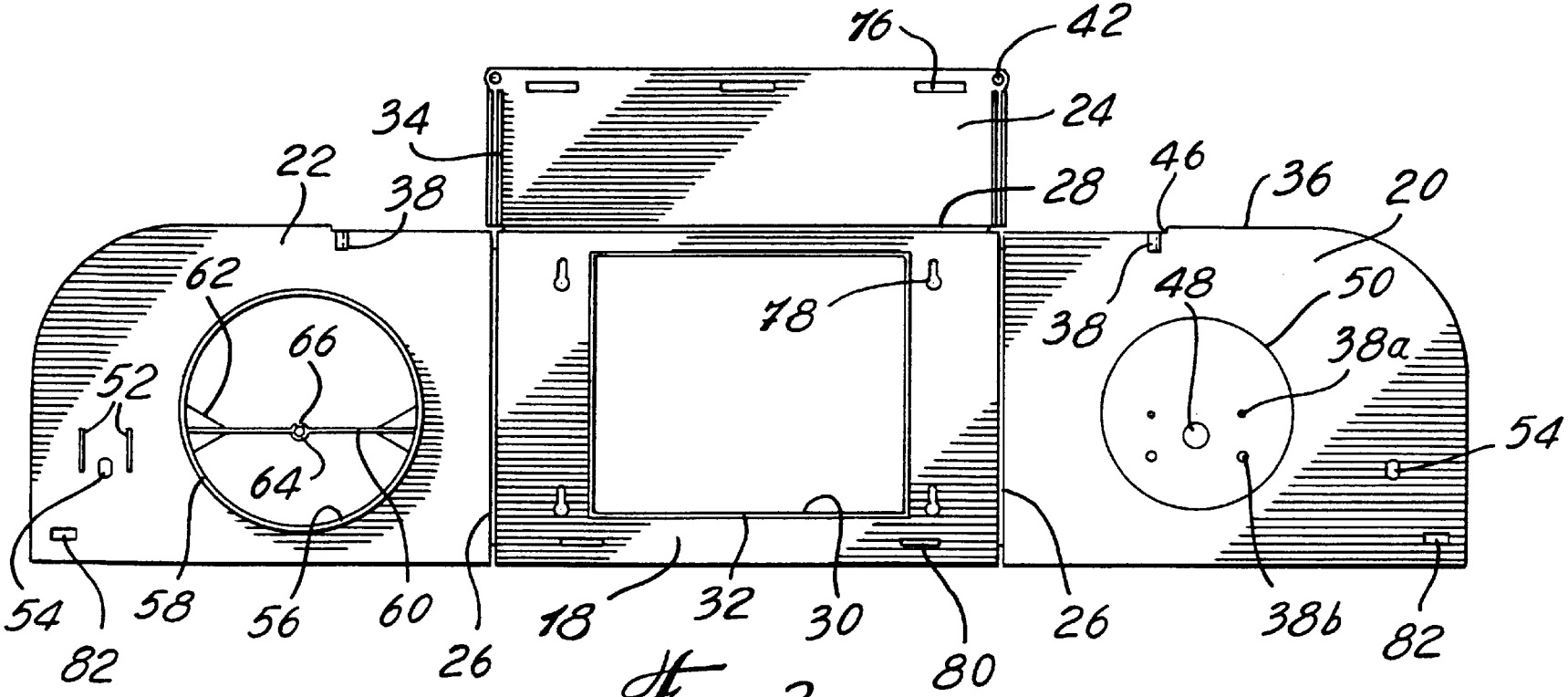
FIG. 3 is an elevation of the housing component of FIG. 2 in flattened condition.
Figure 4:
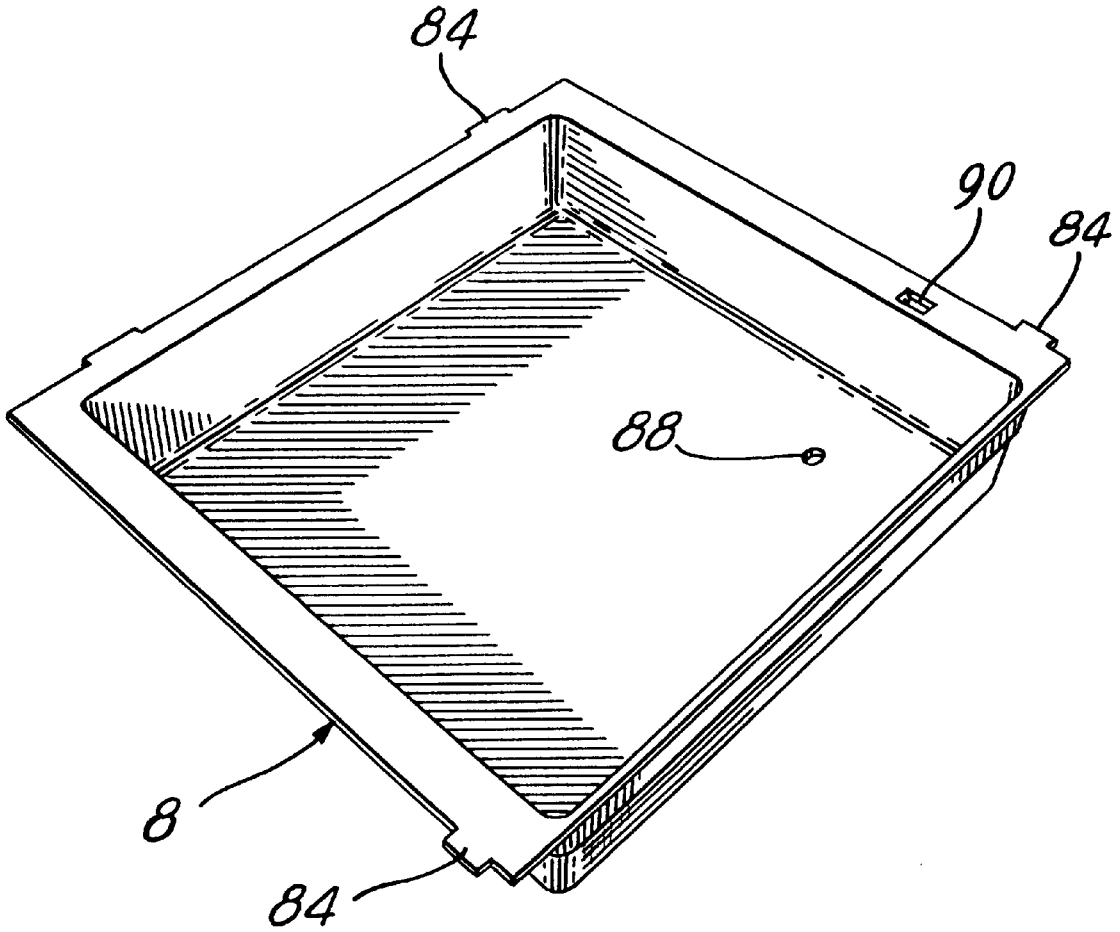
FIG. 4 is a perspective view of the water tray.

As shown in FIG. 3, housing component 4 can be stored in a flat position, taking a minimum of room for instance in the truck of the humidifier installer. The installer quickly forms the reversible housing component 4 into either one of its operative positions, both positions being a mirror image of the other.

Figure 5:
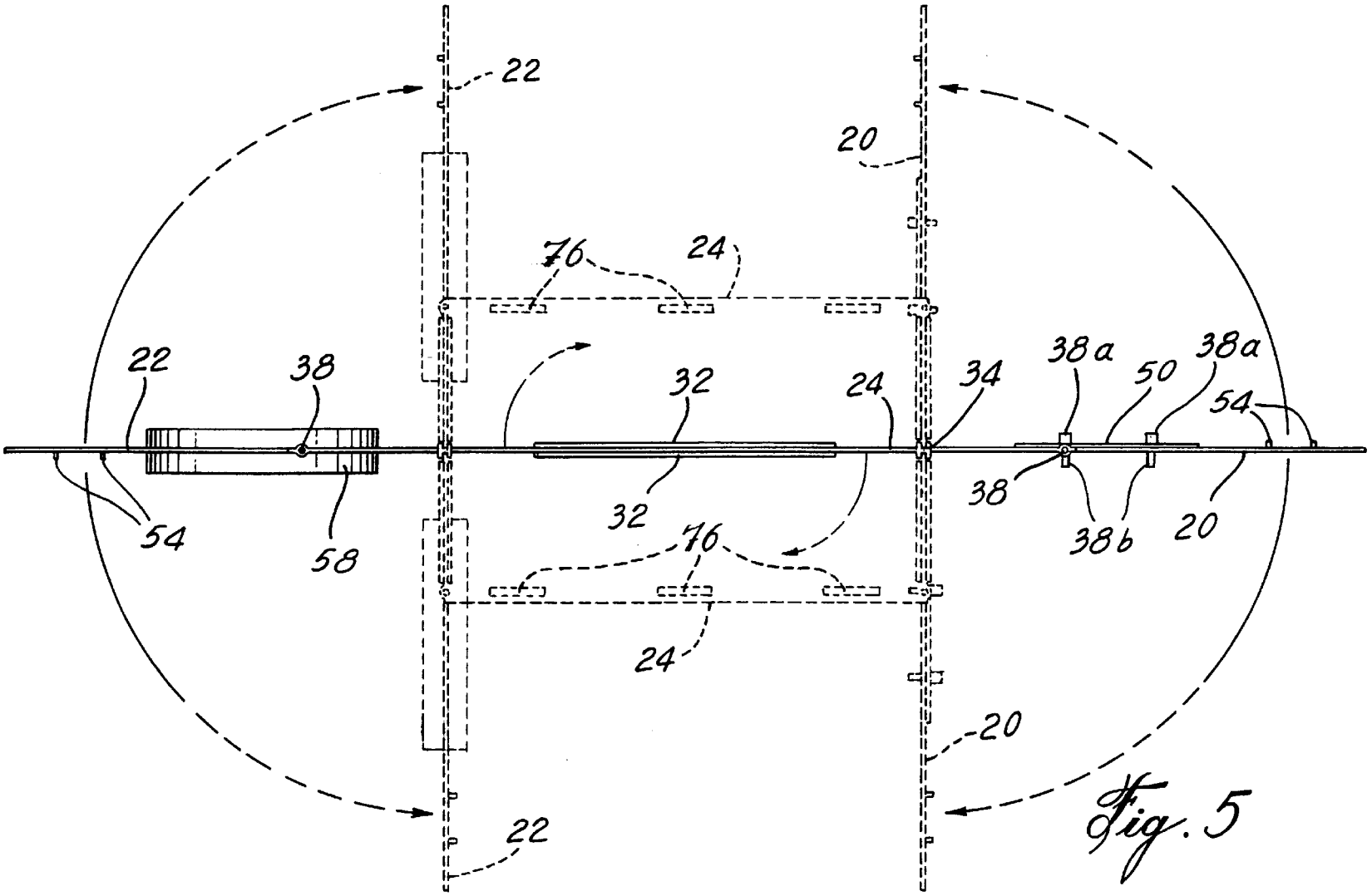
FIG. 5 is a top edge view of the housing component of FIG. 3 showing its two operative folded positions.

As shown in FIG. 5, the top wall and side walls are folded either to one side or to the other with respect to the flattened position of FIG. 3 so as to form the housing with the second air passage 56 to the left or to the right of the housing. Similarly, the float valve can be secured to the left or the right of the housing.

It is noted that housing component together with nipples 38, 38*a*, 38*b*, ribs 34, 52 and bar 60 are molded in one piece and formed with holes 42,48, 76, 80, 82 and air passages 30, 56 with flanges 32, 58 and 50.

We claim:

1. In a humidifier for attachment to the ducts of a forced air heating system to humidify air circulating in the system, a reversible housing including a sheet defining a back wall with a back air passage and adapted to be attached to one of said ducts with either one of its faces flat against said one duct, first and second side walls, first hinge means connecting said side walls to said back wall about spaced hinge axes on either side of said back air passage for pivotal movement to take either one of two operative positions, both protruding forwardly of said back wall depending on which one of said back wall faces is to be attached flat against said one duct, drive unit mounting means carried by said first side wall and accessible from both faces of the latter, said second side wall having a side air passage and a humidifier shaft bearing bar secured to said second side wall and extending across said side air passage, said sheet forming a housing component capable of being formed with said side air passage to the left or to the right of said back air passage, depending on the selected operative position of said side walls, to house a cylindrical humidifier drum between said side walls and rotatably supported by said bar at one end and at its other end by a drive unit carried by said mounting means.

2. In a humidifier as defined in claim 1, wherein said sheet is a unitary sheet with fold lines constituting said first hinge means.

3. In a humidifier as defined in claim 2, further including a duct connector flange means surrounding said side air passage, integral with said second side wall and protruding from both faces of said second side wall for coupling to another one of said ducts in either operative position of said second side wall.

4. In a humidifier as defined in claim 3, further including a second duct connector flange means surrounding said back air passage, integral with said back wall and protruding from both faces of said back wall for coupling with said one duct with either one of the faces of said back wall flat against said one duct.

5. In a humidifier as defined in claim 4, further including hole means in said back wall to enable attachment of said back wall with either one of its faces flat against said one duct.

6. In a humidifier as defined in claim 1, wherein said sheet further includes a top wall, second hinge means connecting said top wall to said back wall about a hinge axis normal to said spaced hinge axes and overlying said back air passage for pivotal movement to take either one of two operative positions protruding forwardly of said back wall respectively, corresponding to the two operative positions of said side walls.

7. In a humidifier as defined in claim 6, wherein said sheet is a unitary sheet with fold lines constituting said first and said second hinge means.

8. In a humidifier as defined in claim 7, wherein each side wall has a top edge and further including groove means extending along each side edge of said top wall and formed at each of its faces to selectively receive said top edges of said side walls in either one of the two operative positions of said side walls and of said top wall.

9. In a humidifier as defined in claim 7, wherein each side wall has a top edge and a front edge generally normal to and parallel to said back wall respectively, said reversible housing further including a rigid angular cover fitting said top and front edges of each side wall in either one of said two operative positions of said side walls and of said top wall.

10. In a humidifier as defined in claim 9, further including groove means extending along each side edge of said top wall and formed at each of its faces to selectively receive said top edges of said side walls in either one of said two operative positions of said side walls and top wall.

11. In a humidifier as defined in claim 9, wherein said cover has side flanges releasably overlying the top and front edges of said side walls in either one of said two operative positions of said side walls.

12. In a humidifier as defined in claim 11, wherein said top wall has cover retaining openings to receive tabs of said cover in either one of the two operative positions of said top wall.

13. In a humidifier as defined in claim 9, wherein said reversible housing further includes a rigid water tray forming the bottom wall of said housing, said tray having ears protruding from its periphery to releasably engage tray retaining openings made through said back and side walls along the bottom edges of the latter, said engagement being effected from either face of said back and side walls.

14. In a humidifier as defined claim 8, further including internally threaded nipples formed at said top edge of each side wall and registering with screw receiving holes made through said top wall in either one of the two operative positions of said top and side walls to receive and retain screws for securing said top wall over said side walls in either one of the two operative positions of said top and side walls.

15. In a humidifier as defined in claim 2, wherein said bar forms a transverse nipple with a longitudinally extending slit through bore for receiving a humidifier drum shaft and releasably retain said shaft with a snap fit.

16. In a humidifier as defined in claim 13, further including float valve mounting means formed on each side wall.

17. In a humidifier as defined in claim 1, wherein said drive unit mounting means include internally threaded screw receiving nipples protruding from each face of said first side wall.

18. In a humidifier as defined in claim 17, wherein said drive unit mounting means further include a hole made through said first side wall and located below the nipples protruding from one face of said first side wall and above the nipples protruding from the other face of said first side wall.

19. In a humidifier as defined in claim 2, further including a cylindrical deodoriser body releasably mounted on said drum shaft within said humidifier drum.

20. A humidifier for attachment to the ducts of a forced air heating system to humidify air circulating in the system comprising a reversible housing including a housing component made of sheet material including a back wall, with a back air passage, means to attach said back wall with either one of its faces flat against one of said ducts and with said back air passage in register with a duct opening in said one duct, first and second side walls and a top wall hinged to said back wall about spaced hinged axes on either side of said back air passage and along the top of said back wall respectively for pivotal movement to take either one of two operative positions both in which said top and side walls protrude forwardly of said back wall depending which one of said back wall faces is attached flat against said one duct, said first side wall being formed with drive unit mounting means accessible at either one of the two faces of said first side wall, said second side wall having a side air passage and a humidifier shaft bearing bar secured to said second side wall and extending across said side air passage, a humidifier drum extending between said side walls, a humidifier shaft supporting said drum and in turn releasably supported by said bar at one end and by a drive unit secured to said drive unit mounting means at the other end, both said back and side air passages surrounded by oppositely directed duct coupling flanges, screw means to secure said top wall over said side walls in either one of said two operative positions, said housing further including a rigid cover fitting said side walls in either of said two operative positions and a water-receiving tray having ears at its periphery to releasably engage tray retaining openings made through said back wall and said side walls along the bottom edges of said back and side walls, said engagement being effected from either face of said back and side walls, said tray constituting the bottom wall of said reversible housing.

21. A humidifier as defined claim 20, further including a cylindrical deodoriser body releasably mounted on said drum shaft within said humidifier drum.

* * * * *